United States Patent [19]

Diez et al.

[11] Patent Number: 4,779,399

[45] Date of Patent: Oct. 25, 1988

[54] METHOD OF AND APPARATUS FOR DRAPING WEBS AROUND BLOCK-SHAPED OBJECTS

[75] Inventors: Werner Diez, Frickenhausen; Peter Gottwald, Metzingen, both of Fed. Rep. of Germany

[73] Assignee: Womako Maschinenkonstruktionen GmbH, Nürtingen, Fed. Rep. of Germany

[21] Appl. No.: 88,937

[22] Filed: Aug. 24, 1987

[30] Foreign Application Priority Data

Aug. 22, 1986 [DE] Fed. Rep. of Germany ..... 3628630

[51] Int. Cl.[4] ..... B65B 9/02; B65B 11/10

[52] U.S. Cl. ..... 53/450; 53/553

[58] Field of Search ..... 53/450, 553, 229, 452, 53/461, 550

[56] References Cited

U.S. PATENT DOCUMENTS

| | | | |
|---|---|---|---|
| 3,090,174 | 5/1963 | Kraft | 53/450 X |
| 3,490,194 | 1/1970 | Monaghan | 53/450 |
| 4,169,344 | 10/1979 | Ganz et al. | 53/553 X |
| 4,396,447 | 8/1983 | Firth | 53/553 X |

*Primary Examiner*—Horace M. Culver

*Attorney, Agent, or Firm*—Peter K. Kontler

[57] ABSTRACT

Successive block-shaped objects of a continuously moving row of objects are draped into two continuously moving webs by causing one of the webs to advance in a horizontal plane below the moving row of objects so that the marginal portions of the one web extend laterally beyond the objects. The other web is converted into an inverted U-shaped body which overlies three sides of each object and has two laterally outwardly extending marginal portions which overlie and are thereupon welded to the respective marginal portions of the one web. Conversion of the other web into the inverted U-shaped body can take place in several successive stages.

21 Claims, 2 Drawing Sheets

METHOD OF AND APPARATUS FOR DRAPING WEBS AROUND BLOCK-SHAPED OBJECTS

BACKGROUND OF THE INVENTION

The invention relates to improvements in methods of and in apparatus for draping successive objects of a series of objects into a wrapping material, especially into webs of wrapping material. More particularly, the invention relates to improvements in methods of and in apparatus for draping the objects (especially substantially block-shaped objects, such as stacks of overlapping paper sheets) into pairs of deformable webs of wrapping material.

It is already known to drape successive objects of a row of block-shaped or like objects into a pair of webs one of which is supplied from below and the other of which is supplied from above. The marginal portions of the webs are caused to overlie each other to be thereupon welded or otherwise sealingly secured to each other. It is also known to thereupon provide the resulting tubular body with transversely extending seams, so as to segregate successive objects from each other, and to sever the overlapping webs along such seams so that the objects become physically separated from each other. If the webs are made of shrinkable plastic or like material, the separated draped objects are introduced into a heating chamber wherein the webs shrink to form envelopes which closely conform to the outlines of the respective objects.

German Offenlegungsschrift No. 25 12 005 discloses an apparatus wherein two elongated webs are draped around a series of successive objects in such a way that each web forms a substantially U-shaped or trough-shaped body and the two bodies are mirror symmetrical to each other. If the objects are block-shaped commodities, the marginal portions of the two U-shaped bodies abut each other at a level substantially midway between the upper sides and the undersides of the objects. The width of the two webs suffices to ensure that the U-shaped bodies are provided with laterally outwardly extending marginal portions which are thereupon welded to each other so that the two bodies together form an elongated tubular envelope containing a series of spaced-apart objects.

A modified draping apparatus is disclosed in German Offenlegungsschrift No. 25 19 144 wherein a single web is converted into a tube with two flaps formed by the marginal portions of the web. The flaps overlap and are thereupon bonded to each other. The overlapping flaps are adjacent one side of the row of objects which are confined in the tube.

Each of the aforedescribed apparatus exhibits a number of drawbacks. Thus, if the marginal portions of a single web or of two webs overlap each other at a level between the upper sides and the undersides of the respective objects, such marginal portions can interfere with the introduction of discrete wrapped and sealed objects into boxes or other types of containers. Moreover, the marginal portions which are disposed at such levels detract from the appearance of the draped and sealed objects, and they cannot be readily reached to be removed in order to afford access to the confined objects.

OBJECTS AND SUMMARY OF THE INVENTION

An object of the invention is to provide a novel and improved method of draping a succession of objects into a pair of deformable webs in such a way that one and the same pair of webs can be used for the draping of taller, shorter, wider and/or narrower objects with the same degree of reliability.

Another object of the invention is to provide a method which renders it possible to place the overlapping marginal portions of the webs at levels where they are least likely to interfere with boxing or crating of the confined objects and where they can be readily reached for separation of envelopes from the respective objects.

A further object of the invention is to provide a novel and improved apparatus for the practice of the above outlined method and to construct and assemble the apparatus in such a way that it can drape a pair of webs around a series of objects without the development of creases.

An additional object of the invention is to provide the apparatus with novel and improved means for manipulating the webs and with novel and improved means for tightly applying at least one of the webs around the objects, particularly around stacks of overlapping paper sheets or the like.

Still another object of the invention is to provide an apparatus which can be rapidly converted for the draping of taller or shorter objects and/or for the draping of wider or narrower objects with the same degree of efficiency and at the same speed.

A further object of the invention is to provide the apparatus with novel and improved means for draping one of the webs around several sides of each of a succession of block-shaped or otherwise configurated commodities while the webs and the commodities are in continuous motion.

One feature of the present invention resides in the provision of a method of draping a succession of objects into a pair of webs. The method comprises the steps of transporting the objects along a predetermined path in a predetermined direction, advancing one of the webs in the predetermined direction longitudinally adjacent one side of the path so that the one web is substantially flat and its marginal portions extend laterally outwardly beyond the path, conveying the other of the webs in the predetermined diection longitudinally along another side of the path, and converting the other web into a substantially U-shaped body having two marginal portions which overlie the marginal portions of the one web.

The one web is preferably adjacent the underside and the other web is then adjacent the upper side of the path.

If the objects are substantially block-shaped commodities each of which has six sides, the transporting step preferably comprises moving the objects in such a way that four sides of each object are parallel to the predetermined direction. The one web is adjacent one of these four sides, and the other web is adjacent the other three of such four sides of each object.

The objects are preferably transported continuously, and the webs are continuously moved along the respective sides of the path.

The U-shaped body which is obtained as a result of conversion of the other web has a central portion and two intermediate portions each of which is inclined with reference to and each of which is disposed between the central portion and one of the respective marginal portions (i.e., one of the marginal portions of the U-shaped body). The converting step preferably includes folding a first part of the other web at least once to form the central portion of the U-shaped body, folding each of the two second portions at least twice to form the central portions, and folding each of two third parts of the other web at least thrice to form the marginal portions of the U-shaped body.

Another feature of the present invention resides in the provision of an apparatus for draping successive objects of a series of objects into a pair of strips or webs. The apparatus comprises means for transporting the objects along a predetermined path (preferably along a substantially horizontal path) in a predetermined direction, means for advancing one of the webs in the predetermined direction so that the one web advances longitudinally adjacent one side of the path and the one web remains or becomes substantially flat and its marginal portions extend laterally outwardly beyond the path, and means for conveying the other web in the predetermined direction so that the other web advances longitudinally along another side of the path. The conveying means includes or cooperates with means for converting the other web into a substantially U-shaped body having two laterally outwardly extending marginal portions which at least partially overlie the marginal portions of the one web. At least a portion of the conveying means can be located above the path, and the advancing means is then located beneath the path of the transported objects.

In accordance with a presently preferred embodiment of the apparatus, the converting means comprises a first draping device having means for transforming the other web into a substantially U-shaped blank having a longitudinally extending central portion or panel and two marginal portions or panels, and a second draping device having a plurality of draping elements (in the form of flaps, plates, edges, swords and the like) serving to convert the central panel of the blank into a first portion of the U-shaped body which is adjacent the other side of the path and into two additional portions which extend from the other side to the one side of the path and are provided with the respective marginal portions which are caused to at least partially overlie the marginal portions of the one web. The second draping device preferably defines a tunnel for successive objects and for the U-shaped blank, and the transforming means preferably extends to the inlet of such tunnel.

The draping elements can include three draping edges which define the inlet of the tunnel and together form a substantially U-shaped draping edge extending not unlike a gantry over the plane of the one web. These draping edges include two parallel edges and a third edge extending at right angles to and disposed between the parallel edges. The draping elements can further include two draping edges extending in parallelism with the predetermined direction adjacent the one side of the path. The draping elements of such second draping device further include two preferably wing-like draping elements adjacent the draping edges which extend in parallelism with the predetermined direction and extend laterally outwardly away from the path along the marginal portions of the webs. Such wing-like draping elements can be provided with edge faces which diverge from the respective draping edges (namely from the draping edges which extend in parallelism with the predetermined direction) in the predetermined direction. The draping elements of the second draping device can further include two draping swords having draping edges adjacent the draping edges which extend in parallelism with the predetermined direction. The transforming means has edge faces which are spaced apart from and are substantially aligned with the draping edges of the respective swords.

Each marginal portion of each web has an inner edge and an outer edge, and the draping edge of each sword preferably halves (or nearly halves) an angle (particularly an acute angle) one side of which is formed by a first line extending transversely of the respective marginal portion of the other web and the other side of which is formed by a second line crossing the first line at the inner edge of the respective marginal portion and extending to a remote point on the respective edge face of the transforming means.

The parallel draping edges which define a portion of the inlet of the tunnel slope toward the one side of the path in the predetermined direction.

The transforming means of the first draping device preferably slopes toward the one side of the path counter to the predetermined direction, and such transforming means can be provided with aforementioned lateral edge faces which preferably converge toward each other counter to the predetermined direction. The draping elements which define the parallel draping edges at the inlet of the tunnel are preferably adjacent the edge faces of the transforming means and extend at right angles to the latter.

The transforming means can include several sections and carrier means for adjustably supporting at least one of the sections so that the one section can be moved to a plurality of positions by moving transversely of the predetermined path. Furthermore, the first draping device can include two parts one of which is nearer to and the other of which is more distant from the one side of the path. Such draping device then further comprises means for adjustably mounting at least one of the parts so as to enable the adjustable part to alter the height of the tunnel.

The U-shape body which constitutes the converted other web includes a central portion or panel and two intermediate portions each of which is inclined with reference to and each of which is disposed between the central portion and one marginal portion of the other web. The converting means includes means for folding a first part of the other web at least once to form the central portion or panel of the U-shaped body, means for folding each of two second parts of the other web at least twice to form the intermediate portions of the U-shaped body, and means for folding each of two third parts of the other web at least thrice to form the marginal portions of the U-shaped body.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
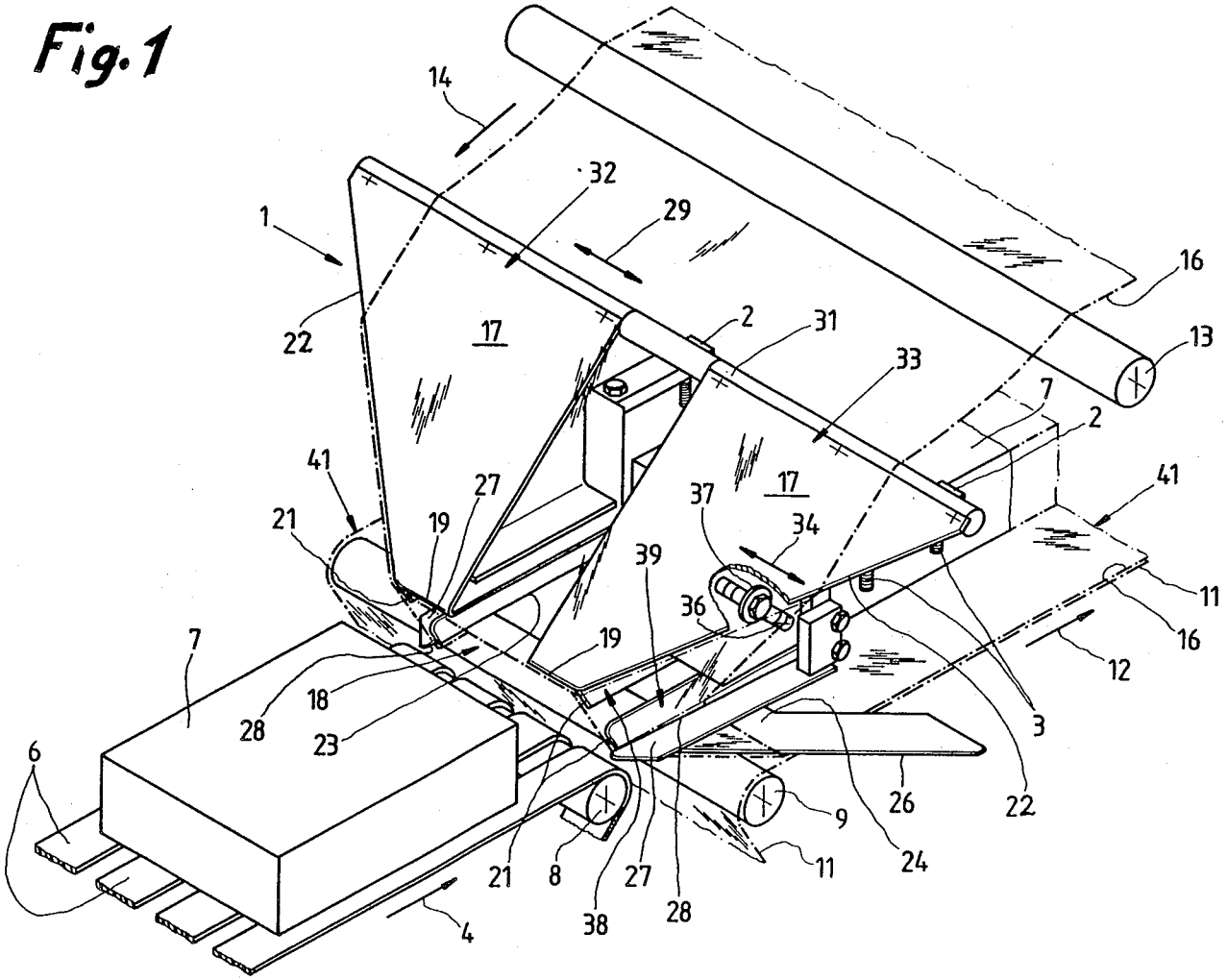
FIG. 1 is a perspective view of a draping apparatus which embodies one form of the invention, the first draping device being partly broken away and the webs of wrapping material being indicated by broken lines.

FIG. 1 shows an apparatus which serves to drape a succession of block-shaped objects 7 into a pair of elongated webs 11 and 16. The objects 7 can constitute stacks of overlapping paper sheets which are transported by a set of parallel endless conveyor belts 6 in the direction of arrow 4 along a substantially horizontal path and in such a way that four sides of each object 7 are parallel to the direction which is indicated by the arrow 4. The conveyor belts 6 are trained over a driven front pulley 8 which deflects them downwardly while the object 7 which is adjacent the pulley 8 continues to advance in the direction of arrow 4 and thus enters a tunnel which is lined by the webs 11 and 16 to be confined in the webs in such a way that its underside is adjacent and flush or nearly flush with the lower web 11 and the two marginal portions 41 of this web extend laterally beyond the object. The other three sides which are parallel to the direction indicated by arrow 4 are overlapped by the upper web 16 which is converted into an inverted U-shaped body having two laterally and outwardly extending marginal portions or flanges 41 which overlie the similarly referenced marginal portions of the web 11. Thus, the webs 11 and 16 together form an elongated tubular envelope with a lower panel formed by the web 11 and the marginal portions 41 of the web 16, an upper panel formed by the median portion of the web 16, and two side panels formed by those portions of the web 16 which extend between the median portion and the respective marginal portions 41. The upper and lower marginal portions 41 are then welded to each other, and the webs 11 and 16 are welded to each other transversely between successive objects 7. Such transverse welds are formed simultaneously with severing of the webs so that each object 7 is draped individually and can be transported to storage or to a machine wherein it is introduced into a box, either individually or jointly with one or more additional draped and sealed objects. The webs 11 and 16 can be made of shrinkable plastic foil which is caused to closely conform to the outlines of the objects 7 upon completion of the welding and severing operations.

The means for advancing the lower web 11 comprises a roller 9 which is or can be driven and is parallel to and located in front of the pulley 8 for the conveyor belts 6. The web 11 is supplied from below, e.g., by being drawn off a bobbin (not shown), and is then caused to advance in the direction of arrow 4 as indicated by the arrow 12. The width of the web 11 need not be changed during and/or after deflection by the roller 9. If the diameter of the roller 9 matches the diameter of the pulley 8, the axis of the roller 9 is or can be located at a level of the axis of the pulley 8. This ensures that the web 11 advances in the direction of arrows 4 and 12 at a level closely or immediately beneath the underside of the adjacent object 7; such object rests on the web 11 as soon as it advances beyond the pulley 8.

The means for conveying the web 16 first toward the roller 9 (in the direction of arrow 14, i.e., counter to the direction of arrows 4 and 12) includes a roller 13 which is located downstream of the pulley 8 and roller 9 and directs successive increments of the running web 16 toward and into engagement with the exposed rearwardly and downwardly sloping side or surface of a first draping device 1 having two coplanar web transforming sections 17 with lateral edge faces 22 which cause transformation of the web 16 into an inverted U-shaped blank having a relatively wide central portion overlying the object 7 which advances beyond the pulley 8 and two downwardly extending portions or legs which are to be converted, in part, into the respective marginal portions 41 and to then overlie the marginal portions 41 of the lower web 11. The first draping device 1 is mounted on several brackets 2 which are secured to the main frame (not shown) of the improved apparatus by screws 3 or other suitable fasteners.

The blank which is formed by the first draping device 1 is delivered into the range of a second draping device 18 which transforms the just discussed inverted U-shaped blank into a U-shaped body which overlies three sides of the path for the objects 7 and includes the aforementioned laterally outwardly extending marginal portions 41 overlying the marginal portions 41 of the lower web 11. The device 18 defines a tunnel which is immediately adjacent the path of movement of three sides of the oncoming object 7 and is open from below, i.e., its open side faces the web 11 between the marginal portions 41 of the latter. The exposed surfaces of the web transforming sections 17 of the first draping device 1 are preferably flat and smooth so as to offer little resistance to advancement of the continuously moving or running web 16. The web 11 is also running at all times, i.e., the means for advancing the web 11 and the means for conveying the web 16 are operated continuously rather than stepwise.

The second draping device 18 comprises two folding edges 19 which are provided on the rearmost and lowermost portions of the sections 17 and serve to deflect the central portion of the centrally located panel of the inverted U-shaped blank (converted web 16) in the direction of arrows 4 and 12 so that such central portion overlies the upper side of the oncoming object 7. The draping device 18 further includes two lateral folding or draping elements 21 which have edge faces serving to cause the blank to develop two portions which overlie the vertically extending lateral sides of the adjacent object 7 and extend downwardly from the deflected central portion of the centrally located panel of the U-shaped blank. FIG. 1 shows that the edge faces 22 of the sections 17 guide the legs of the inverted U-shaped blank toward the folding edges 19 and folding elements 21 at the inlet of the tunnel so as to facilitate the task of the draping device 18, namely to convert the inverted U-shaped blank into a body having portions adjacent three sides of the object 7 and further having two marginal portions 41 which overlie the marginal portions 41 of the web 11. The height of the draping elements 21 decreases in the direction of arrow 12 and their rearmost portions are in line with the respective folding edges 19 on the sections 17. The planes of the draping elements 22 are or can be normal to the planes of the sections 17.

The draping device 18 further comprises two draping or folding edges 23 which extend in the direction of arrow 12 and are located beneath the respective draping elements 21 to initiate the making of the respective marginal portions 41. The making of such marginal portions is further assisted by two substantially wing-like folding or draping elements 24 which are adjacent the respective draping edges 23 and extend laterally outwardly, i.e., away from the respective sides of the path for the objects 7. The wing-like draping elements 24 are adjacent the upper sides of the path of marginal portions 41 of the lower web 11. As can be seen in the drawing, the outer edge faces 26 of the draping elements 24 slope laterally outwardly as well as forwardly in the direction of the arrow 12. The draping elements 24 cooperate with additional draping elements 27 in the form of so-called swords which overlie the respective draping elements 24 adjacent the corresponding edges 23 to provide narow slots for the marginal portions 41 of the web 16. The swords 27 have folding or draping edges 28 which extend in the direction of arrow 12 and are adjacent and cooperate with the respective draping edges 23.

The inlet of the tunnel which is defined by the second draping device 18 is bounded by three draping edges, namely by the composite draping edge including the two draping edges 19 and by the rear edges of the draping elements 21. Such rear edges slope forwardly (as seen in the direction of arrow 12) toward the underside of the path for the objects 7, i.e., toward the plane of the web 11. The rear edges of the draping elements 21 preferably extend at right angles to the adjacent draping edges 19.

In order to enhance the versatility of the apparatus, i.e., to ensure that the apparatus can be used for the draping of objects 7 having different widths and/or heights, the topmost and foremost portions 32, 33 of the sections 17 of the first draping device 1 are adjustably mounted on a rod-shaped carrier 31 which is parallel to the roller 13 and enables each section 17 to move in the directions indicated by a double-headed arrow 29 prior to being locked or arrested in the newly selected position. The sections 17 constitute an upper part 38 of the draping device 1, and such upper part is adjustable with reference to a lower part 39 upon loosening of arresting bolts 37 extending into elongated slots 36 of the aforementioned frame. One such bolt is provided at each side of the device 1. The part 38 is adjustable in directions indicated by a double-headed arrow 34.

The operation:

The drive means for the conveyor belts 6 is operative to advance the series of objects 7 at the speed at which the webs 11 and 16 are advanced. The web 11 can be advanced by the roller 9, and the web 16 is advanced because its marginal portions 41 are welded to the marginal portions 41 of the web 11. The lower web 11 is advanced along the undersides of the objects 7, and the upper web 16 is acted upon by the transforming sections 17 of the first draping device 1 to form the aforementioned blank which advances into the range of the second draping device 18. The edges 19 and the draping elements 21 cause the blank to overlie the lateral surfaces of the adjacent object 7 so that the inverted U-shaped blank is adjacent three sides of the object 7 in the region downstream of the pulley 8 while the central portion of the web 11 overlies the fourth side (underside) of such object. The conversion of the web 16 into an inverted U-shaped body with two laterally outwardly extending marginal portions 41 takes place without the development of any folds or creases. The width of the web 16 is selected in such a way that, even though the draping edges 19 and the draping elements 21 cooperate to reduce the width of the blank during conversion of the blank into the inverted U-shaped body with marginal portions 41, the web 16 completely overlies three of four of those sides of the adjacent object 7 which extend in parallelism with the directions indicated by arrows 4 and 12 and that there remains sufficient material to form the upper marginal portions 41 which overlie the marginal portions 41 of the lower web 11. The making of upper marginal portions 41 is effected by the draping edges 24 and the wing-like draping elements 24. The upper marginal portions 41 are thereupon welded to the lower marginal portions 41 in a manner not forming part of the present invention so that each object 7 is confined from four sides.

As shown in FIG. 1, each draping element 21 actually includes two portions one of which is defined by the upper part 38 and the other of which is defined by the lower part 39 of the first draping device 1. The combined length of the two folding edges 19 and of the two two-piece folding elements 21 plus the width of the two upper marginal portions 41 equals the width of the web 16.

The swords 27 and their edges 38 cooperate with the wing-like draping elements 24 and their edge faces 26 to ensure that the web 16 is draped around three sides of each object 7 without the development of creases.

If the illustrated objects 7 are replaced with different objects, the apparatus is converted in a simple and time-saving manner by changing the mutual spacing of the portions 32, 33 along the rod-like carrier 31. The length of the inclined edge faces 22 and 26 suffices to ensure that the sections 17 of the first draping device 1 and the wing-like draping elements 24 can be used for the draping of wider or narrower as well as taller or flatter objects with the same degree of accuracy. The apparatus can process webs 11 and 16 of different widths, depending on the dimension of the objects 7. The illustrated webs 11 and 16 need not be replaced whenever the illustrated objects 7 are replaced with differently dimensioned objects; all that counts is to ensure that each of the webs 11 and 16 will develop a pair of narrower or wider marginal portions 41 so that such marginal portions can be bonded to each other downstream of the draping station.

German Offenlegungsschrift No. 34 43 991 discloses an apparatus which can be used to weld the (upper) marginal portions 41 of the web 16 to the (lower) marginal portions 41 of the web 11. The mutual spacing of successively transported objects 7 is such as to enable another apparatus (such as that disclosed in German Pat. No. 20 08 595) to provide the overlapping webs 11 and 16 with transversely extending seams and to simultaneously physically separate successive fully draped and sealed objects 7 from each other. The individual objects 7 (each of which is completely confined and sealed between the respective portions of the webs 11 and 16) are thereupon introduced into a shrinking tunnel, (e.g., of the type disclosed in German Auslegeschrift No. 19 20 863) wherein the web portions which are welded to each other longitudinally as well as transversely of the respective objects are heated and are thereby caused to closely follow the outlines of the respective objects.

The purpose of the lateral edge faces 22 on the sections 17 of the transforming means and of the edge faces 26 on the wing-like draping elements 24 is to ensure that the marginal portions 41 of the web 16 will be formed without the development of creases. The draping edges 19 of the sections 17 cooperate with the rear draping edges of the draping elements 21 to prevent the development of creases in the region of the tunnel 18, i.e., on those portions of the web 16 which overlie the upper side and the lateral sides of the adjacent object 7. The dimensions and positions of the just mentioned draping edges are preferably selected in such a way that the web 16 closely follows the outlines of the adjacent three sides of each object 7 which advances beyond the pulley 8. The draping edges 23 which are parallel to the direction indicated by arrows 4 and 12 serve to ensure crease-free transition between those portions of the web 16 which overlie the lateral sides of the adjacent object 7 and the respective marginal portions 41. The formation of marginal portions 41 which are devoid of creases is desirable and advantageous because this ensures proper sealing of the webs 11, 16 to each other during welding of the upper marginal portions 41 to the lower marginal portions 41. The draping edges 23 are adjacent the plane of the web 11. Those portions of the web 16 which extend laterally beyond the respective draping edges 23 (i.e., the portions which are to form the upper marginal portions 41) extend between the draping elements 24 and the respective swords 27.

The feature that the rear draping edges of the draping elements 21 slope downwardly and forwardly toward the web 11 and that the outer edge faces 26 of the draping elements 24 diverge in the direction of arrow 12 contributes to a reduction of the magnitude of the force which is necessary to pull the web 16 in the direction of arrow 12.

It has been found that the improved apparatus can make satisfactory crease-free envelopes for larger or smaller objects 7 without exchanging the webs 11 and 16. This, in turn, ensures the making of satisfactory welded connections between the upper and lower marginal portions 41. Since a single web (16) is used to cover three sides of each object 7, and since the exact width of the marginal portions 41 is not always of consequence, the apparatus can operate with webs 11, 16 having a single width or with a small number of webs having different widths. This eliminates the need to store large numbers of wider and narrower webs and thus contributes to a reduction of the cost of the packing operation.

Figure 2:
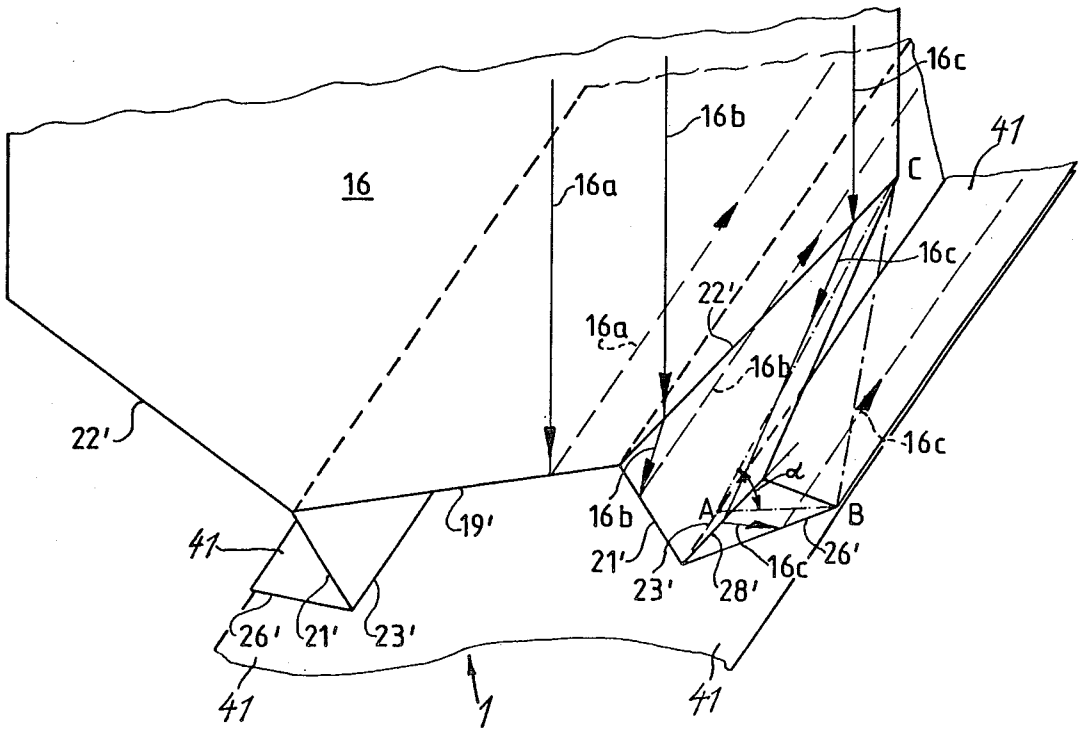
FIG. 2 is a perspective view of the webs, with the apparatus and workpieces omitted.

FIG. 2 shows the lower web 11 with its marginal portions 41 which extend laterally beyond an object (not shown in FIG. 2) between the webs 11 and 16. The fold line which is formed by the folding edges of the web transforming sections 17 is shown at 19', and the fold lines which are formed by the draping or folding elements 21 are shown at 21'. The fold lines 19', 21' extend transversely of the direction of advancement of the web 11 and substantially transversely of the fold lines 22' which are formed by the lateral edge faces 22 of the sections 17. The fold lines 23' are formed by the longitudinally extending draping edges 23 of the draping device 18, and the fold lines 26' are formed by the outer edges 26 of the folding elements 24. Finally, the fold lines 28' are formed by the edge faces 28 of the swords 27. The arrows **16*a* denote the directions of advancement of that portion or strip of the web 16 which constitutes the median portion of the inverted U-shaped body, i.e., of the converted web 16, and the arrows 16*b* denote the directions of advancement of one of those portions or strips of the web 16 which form the panels that overlie the longitudinally extending lateral sides of the objects 7. The arrows 16*c* denote the directions of travel of one of those strips or portions of the web 16 which are converted into the respective marginal portions or flanges 41. The material which advances in the direction of arrows 16*a* moves into the range of and beyond the folding edges 19. The material which advances in the directions indicated by arrows 16*b* reaches the corresponding folding element 21 and edge face 22, and the material which advances in the directions indicated by arrows 16*c* reaches the parts 22, 26 and 28. The path of the lower web 11 beneath the device 18 is or can be horizontal, and the path of the web 16 in the region of the sections 17 preferably makes with the path of the web 11 and angle of 45°. FIG. 2 shows that a single operation (at 19, 19) is necessary to form the central portion of the inverted U-shaped web 16, that three folding operations (see 22', 28', 26') are necessary toform the flanges 41 of the web 16, and that two folding operations (see 22', 21'**) are necessary to form each of the two remaining portions of the inverted U-shaped body.

The exact position of each fold line 28' is determined by the position of the draping edge face 28 on the respective sword 27 along a line which divides the angle alpha shown in FIG. 2. The angle alpha is defined by a line which connects the points A and B on the inner and outer edges of the respective marginal portion 41 of the web 16 and a line which connects the points A, C shown in FIG. 2. The line between A, B extends transversely (i.e., across the width) of the respective marginal portion 41 of the web 16, and the points A, C are respectively located on the fold lines 23' and 22'. The illustrated angle alpha is an acute angle between the hypotenuse and the shorter side of a triangle A, B, C.

The draping devices 1 and 18 can be said to jointly constitute a converting unit which includes means (such as the folding edges 19) for folding at least once a first part of the web 16 so as to form the central portion or panel of the U-shaped body which constitutes the converted web 16, means (such as the folding elements 21 and lateral edge faces 22) for folding at least twice two second parts of the web 16 so as to form the intermediate portions of the inverted U-shaped body (namely the portions between the central portion and the two marginal portions 41 of the web 16), and means (such as the parts 22, 28, 26) for folding two third parts of the web 16 at least thrice so as to form the marginal portions 41 of the U-shaped body. The first part of the web 16 is pulled in the direction of arrows **16*a*, the second parts of the web 16 are pulled in the directions of arrows 16*b*, and the third parts of the web 16 are pulled in the directions of arrows 16*c***.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of draping a succession of objects into a pair of webs, comprising the steps of transporting the objects along a predetermined path in a predetermined direction; advancing one of the webs in said direction longitudinally adjacent one side of the path so that the one web is substantially flat and its marginal portions extend laterally beyond the path; conveying the other of the webs in said direction longitudinally along another side of said path; and converting the other web into a substantially U-shaped body having two marginal portions overlying the marginal portions of the web, a central portion and two intermediate portions each inclined with reference to and each disposed between the central portion and one of the respective marginal portions, said converting step including folding a first part of the other web at least once to form the central portion of the U-shaped body, folding each of two second parts of the other web at least twice to form the intermediate portions of the U-shaped body, and folding each of two third parts of the other web at least thrice to form the marginal portions of the U-shaped body.

2. The method of claim 1, wherein said path has an underside and an upper side, the one web being adjacent the underside and the other web being adjacent the upper side of the path.

3. The method of claim 1 of draping substantially block-shaped objects each having six sides, wherein said transporting step includes moving the objects of said succession in such a way that four sides of each object are parallel to said direction, the one web being adjacent one of said four sides and the other web being adjacent the other three of said four sides.

4. Apparatus for draping a succession of objects into a pair of webs, comprising means for transporting the objects along a predetermined path in a predetermined direction; means for advancing one of the webs in said direction longitudinally adjacent one side of the path so that the one web is substantially flat and its marginal portions extend laterally beyond the path; and means for conveying the other of the webs in said direction longitudinally along another side of the path, including means for converting the other web into a substantially U-shaped body having two laterally outwardly extending maginal portions overlying the marginal portions of the one web, said converting means including a first draping device having means for transforming the other web into a substantially U-shaped blank having a longitudinally extending central panel and two marginal panels, and a second draping device having draping elements arranged to convert the central panel of the blank into a first portion of the U-shaped body which is adjacent the other side of the path and into two additional portions which extend from the other side to the one side of the path and are provided with the respective marginal portions overlying the marginal portions of the one web.

5. The apparatus of claim 4, wherein said conveying means is located above said path.

6. The apparatus of claim 4, wherein said advancing means is located beneath said path.

7. The apparatus of claim 4, wherein said transforming means of the first draping device tapers counter to said direction and is arranged to feed successive increments of the U-shaped blank to said second draping device.

8. The apparatus of claim 7, wherein said second draping device defines a tunnel for successive objects and for the U-shaped band and said transforming means extends to the inlet of said tunnel.

9. The apparatus of claim 8, wherein said draping elements include three draping edges defining the inlet of said tunnel and together forming a substantially U-shaped draping edge.

10. The apparatus of claim 9, wherein said draping edges include two parallel edges and a third edge extending at right angles to and disposed between said parallel edges.

11. The apparatus of claim 8, wherein said draping elements include two draping edges extending in parallelism with said predetermined direction adjacent said one side of said path.

12. The apparatus of claim 11, wherein said draping elements further include two draping elements adjacent said draping edges and extending laterally outwardly away from said path along the marginal portions of the webs.

13. The apparatus of claim 12, wherein said two draping elements have edge faces which diverge from the respective draping edges in said predetermined direction.

14. The apparatus of claim 12, wherein said draping elements further include two draping swords having draping edges adjacent said two draping edges, said transforming means comprising two edge faces each spaced apart from and substantially aligned with the draping edge of the respective sword.

15. The apparatus of claim 14, wherein each of said marginal portions has an inner edge and an outer edge and the draping edge of each of said swords halves an angle one side of which is formed by a first line extending transversely of the respective marginal portion of the other web and the other side of which is formed by a second line crossing said first line at the inner edge of the respective marginal portion and extending to a point on the respective edge face of said transforming means.

16. The apparatus of claim 8, wherein said elements include three draping edges defining the inlet of said tunnel and including two draping edges which slope toward the one side of the path in said predetermined direction.

17. The apparatus of claim 8, wherein the transforming means of said first draping device slopes counter to said direction toward the one side of said path.

18. The apparatus of claim 8, wherein said transforming means has two lateral edge faces which converge toward each other counter to said direction and said draping elements include two draping elements adjacent said edge faces and extending at right angles to said transforming means.

19. The apparatus of claim 8, wherein said transforming means includes a plurality of sections and further comprising carrier means for adjustably supporting at least one of said sections for movement between a plurality of positions transversely of said path.

20. The apparatus of claim 8, wherein said first draping device includes two parts one of which is nearer to and the other of which is more distant from said one side of said path, and means for adjustably mounting at least one of said parts so as to enable the adjustable part to alter the height of said tunnel.

21. Apparatus for draping a succesion of objects into a pair of webs, comprising means for transporting the objects along a predetermined path in a predetermined direction; means for advancing one of the webs in said direction longitudinally adjacent one side of the path so that the one web is substantially flat and its marginal portions extend laterally beyond the path; and means for conveying the other of the webs in said direction longitudinally along another side of the path including means for converting the other web into a substantially U-shaped body having two laterally outwardly extending marginal portions overlying the marginal portions of the one web, a central portion and two intermediate portions each inclined with reference to and each disposed between the central portion and one of the respective marginal portions, said converting means including means for folding a first part of the other web at least once to form the central portion of the U-shaped body, means for folding each of two second parts of the other web at least twice to form the intermediate portions of the U-shaped body, and means for folding each of two third parts of the other web at least thrice to form the marginal portions of the U-shaped body.

* * * * *